US009642405B2

(12) United States Patent
Safford

(10) Patent No.: US 9,642,405 B2
(45) Date of Patent: May 9, 2017

(54) GLOVE WITH CLOSURE MEMBER

(71) Applicant: Mechanix Wear, Incorporated, Valencia, CA (US)

(72) Inventor: Kenneth Safford, Simi Valley, CA (US)

(73) Assignee: Mechanix Wear, Incorporated, Valencia, CA (US)

( * ) Notice: Subject to any disclaimer, the term of this patent is extended or adjusted under 35 U.S.C. 154(b) by 0 days.

(21) Appl. No.: 14/529,776

(22) Filed: Oct. 31, 2014

(65) Prior Publication Data

US 2015/0121605 A1 May 7, 2015

Related U.S. Application Data

(60) Provisional application No. 61/898,898, filed on Nov. 1, 2013.

(51) Int. Cl.
*A41D 19/015* (2006.01)
*A41D 19/00* (2006.01)

(52) U.S. Cl.
CPC ..... *A41D 19/0048* (2013.01); *A41D 19/00* (2013.01); *A41D 19/0044* (2013.01)

(58) Field of Classification Search
CPC ..... A41F 1/06; A63B 71/146; A63B 21/1434; A63B 2209/10; A63B 71/143; A41D 19/0034; A41D 19/0048; A41D 19/01582; A41D 2300/32; Y10S 2/91; Y10S 2/917
See application file for complete search history.

(56) References Cited

U.S. PATENT DOCUMENTS

| | | | | |
|---|---|---|---|---|
| 4,651,345 | A * | 3/1987 | Latina | 2/19 |
| 4,730,354 | A * | 3/1988 | Saito | 2/161.2 |
| 4,962,547 | A * | 10/1990 | Minnick | 2/161.4 |
| 5,197,149 | A * | 3/1993 | Overton | 2/162 |
| 6,286,148 | B1 * | 9/2001 | Meyer | 2/161.1 |
| 8,230,524 | B1 * | 7/2012 | Safford | 2/162 |

* cited by examiner

*Primary Examiner* — Bobby Muromoto, Jr.
(74) *Attorney, Agent, or Firm* — Knobbe, Martens, Olson & Bear, LLP

(57) ABSTRACT

A glove has a top panel and a bottom panel. The top panel has a proximal end. The proximal end defines at least a portion of a cuff of the glove. The proximal end has a length. A strip of loop material extends along the top panel and has a length longer than the length of the proximal end of the top panel.

20 Claims, 2 Drawing Sheets

GLOVE WITH CLOSURE MEMBER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The present application generally relates to gloves. More particularly, the present application relates to gloves with a closure member.

Description of the Related Art

Gloves are used in a variety of contexts to protect the hands of the wearer. The gloves are donned by inserting a hand through a cuff region of each glove. The cuff region can include elastic, can be secured with straps or can remain open, depending upon the style of the glove.

SUMMARY OF THE INVENTION

In some applications, it is advantageous to secure the glove more tightly around a wrist of a wearer. For example, by tightening the cuff against the wrist of the wearer, the glove can be more secure and less dirt and debris may enter into the interior of the glove.

Presently, gloves can be secured using a hook and loop fastener. In such configurations, the hook portion can be secured to the body of the glove while the loop fastener is on a strap that is secured to the hook portion. In such configurations, there is a limit to the amount of adjustability in the closure member. In other words, a fairly narrow range of adjustment is available. Moreover, the limited region that interacts between the hook and loop fasteners can result in a less secure connection than desired. Accordingly, an improved closure member is desired.

In some configurations, a glove comprises a top panel and a bottom panel. The top panel and the bottom panel each comprises a proximal end. The proximal end of the top panel and the proximal end of the bottom panel define an opening. The opening defines a length. A strip of loop material extends along at least a portion of both the proximal end of the top panel and the proximal end of the bottom panel and has a length of more than 50 percent of the length of the opening.

In some configurations, a glove comprises a top panel and a bottom panel. The top panel has a proximal end. The proximal end defines at least a portion of a cuff of the glove. The proximal end has a length. A strip of loop material extends along the top panel and has a length longer than the length of the proximal end of the top panel.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
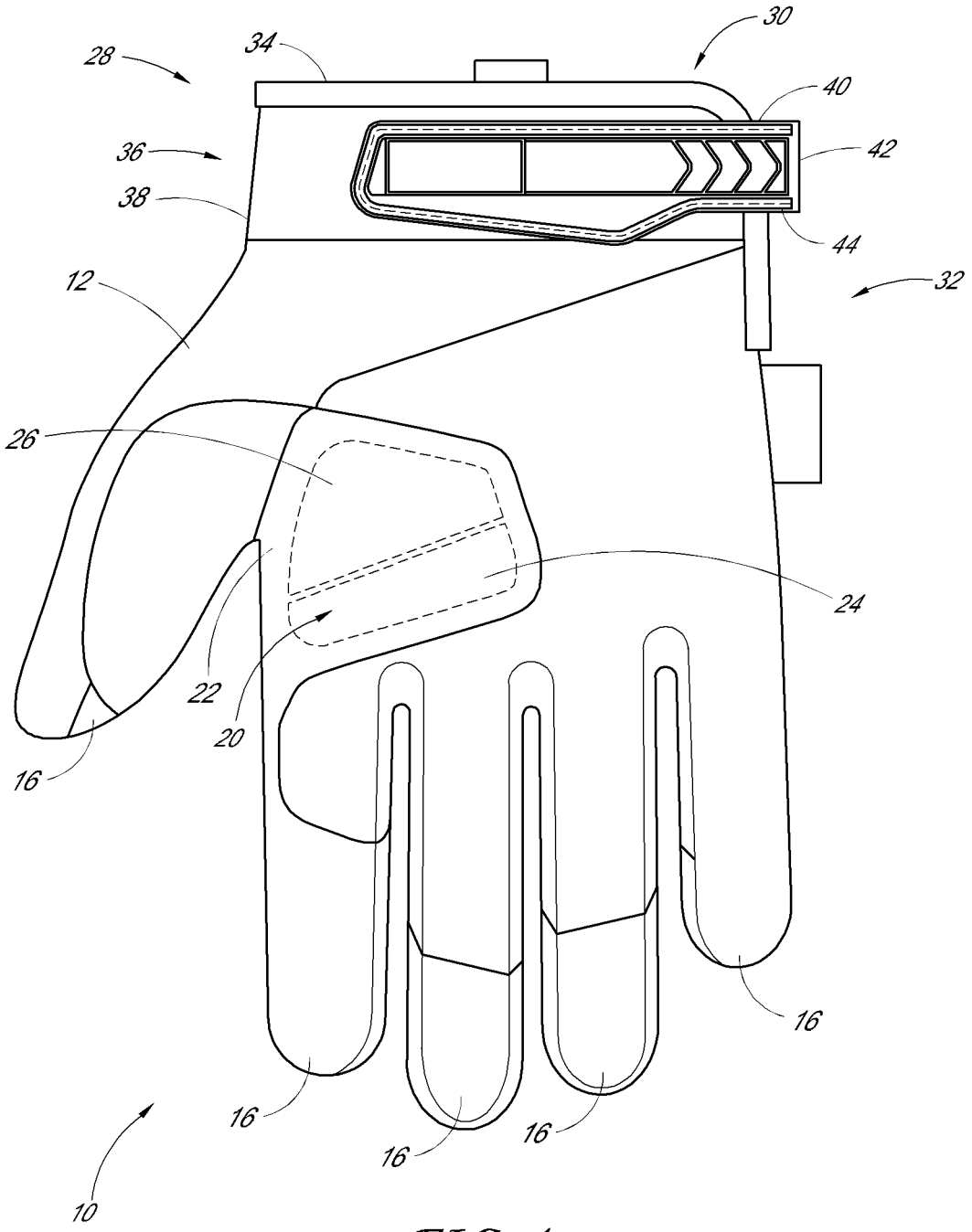
FIG. 1 is dorsal side of a glove that is arranged and configured in accordance with certain features, aspects and advantages of the present invention.

With reference now to FIG. 1, a glove 10 is shown. The glove 10 can be configured to protect the hand of a user. In some configurations, the glove 10 can include one or more features of the glove disclosed in U.S. Pat. No. 8,490,217, issued on Jul. 23, 2013, which is hereby incorporated by reference in its entirety.

With reference to FIG. 1, the glove 10 generally comprises a top panel 12. The top panel 12 can be shaped and constructed to cover a dorsal or back side of a hand. The glove 10 also comprises a bottom panel 14. The bottom panel 14 can be shaped and configured to cover a palmar portion of the hand. In some configurations, the glove can comprise one or more fingers 16. The fingers 16 can be integrally or separately formed relative to the top panel 12 and the bottom panel 14. The fingers can include an index finger, a middle finger, a ring finger, a little finger and a thumb.

In the illustrated configuration, an enlarged protective element 20 can be positioned on the top panel 12. The protective element 20 can have any suitable configuration. In some configurations, the protective element 20 is enveloped within an overlay member 22. The overlay member 22 can be formed of a material different from the material used to form the majority of the top panel 12. In some configurations, the material used for the overlay member 22 is more durable than the material used to form the majority of the top panel 12. In some configurations, the overlay member 22 is formed of a synthetic leather material or leather, for example but without limitation.

The overlay member 22 can extend along at least a portion of the thumb of the glove 10 as well as extend along the back of the hand at the base of the index and middle fingers. In some configurations, the overlay member 22 does not extend to the base of the ring finger. In some configurations, the overlay member 22 extends only to the base of the interdigital gap between the ring finger and the middle finger. In some configurations, the overlay member 22 extends over only two knuckles and terminates just before the third knuckle. In some configurations, the overlay member 22 is separated into a first portion that extends along the thumb and a second portion that extends along the back of the hand. By separating the overlay member 22 into the two portions, the flexibility of the overlay member 22 can be improved. In some configurations, the first portion can be formed of a different material relative to the second portion. The two different materials can provide improved abrasion resistance to the first portion (i.e., the thumb portion).

Figure 2:
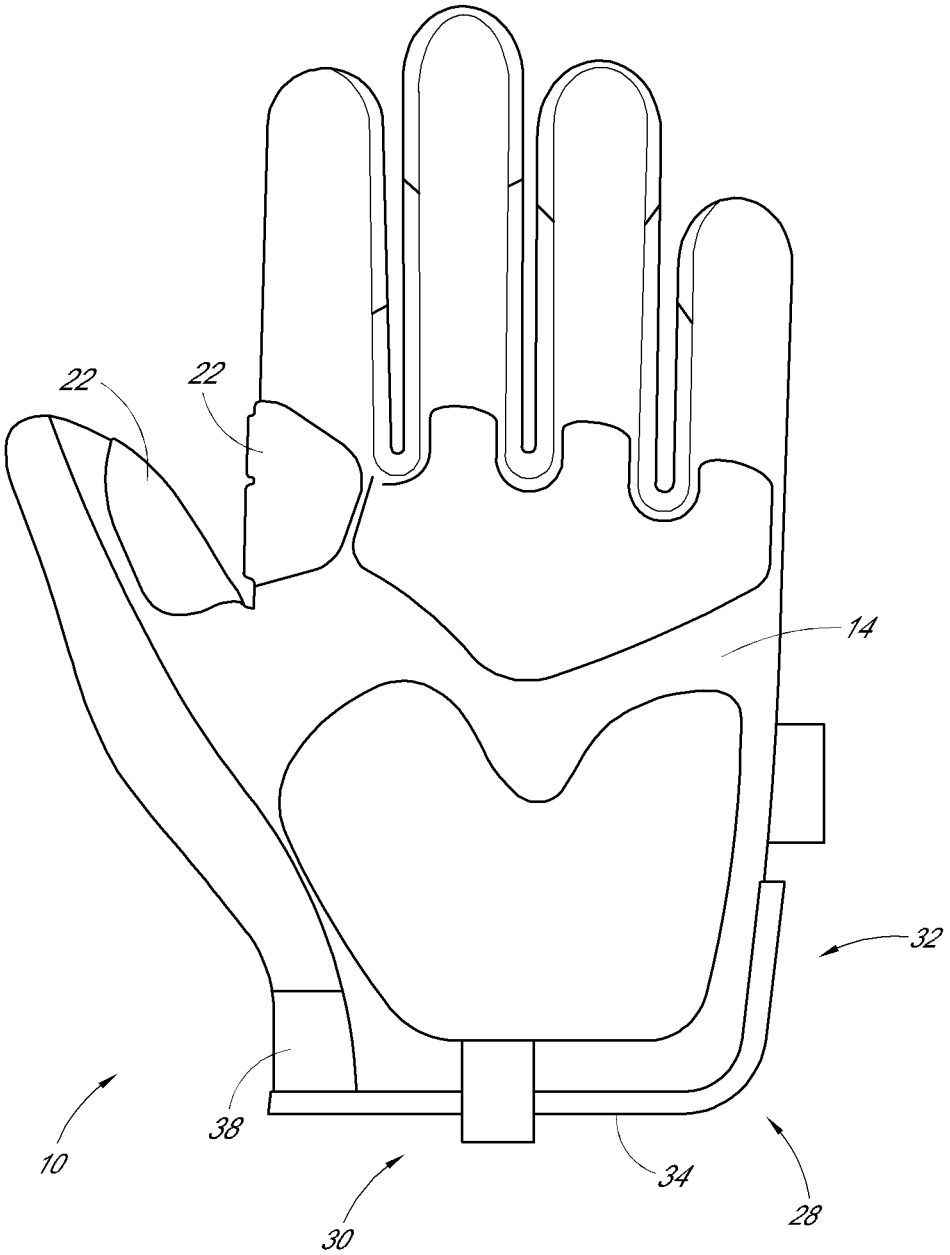
FIG. 2 is a palmar side of the glove of FIG. 1.

With reference to FIG. 2, the overlay member 22 can wrap around at least a portion of the index finger. As illustrated, the overlay member 22 can wrap around at least a portion of the proximal phalanges portion of the index finger. In the illustrated configuration, the overlay member 22 can overlay at least a portion of the bottom panel in the region of the joint between the metacarpal and the proximal phalanges of the index finger. As also shown, the overlay member 22 can overlay a portion of the thumb on the palmar side as well. In the illustrated configuration, the overlay member 22 wraps rearward to portions of the bottom panel 14 that will be in contact with each other when the index finger and thumb are brought together in a flush manner with a flat hand (as opposed to just the tip of the thumb touching the side of the index finger).

With reference again to FIG. 1, the protective element 20 can be divided into a first portion and a second portion 26. The protective element 20 can be formed of any suitable padding material. In some configurations, the protective element 20 is at least partially formed of ethylene-vinyl acetate foam. The first portion 24 and the second portion 26 can be two separate pad members that are spaced by a stitched region. The stitched region can extend generally laterally. In the illustrated configuration, the first portion 24 overlies the lower knuckles of the index finger and the middle finger, as indicated by the "X's" in FIG. 1. In some configurations, the first and second portions 24, 26 cooperate to cover at least the distal halves of the metacarpals of the index and middle fingers.

With reference to FIG. 1, the glove 10 comprises a cuff 28 that defines an opening 30 into which a hand can be inserted. The opening 30 can extend longitudinally along at least a side portion 32 of the glove 10. In the illustrated configuration, the opening 30 extends along the side portion 32 to correspond to the little finger of the hand. Thus, the opening 30 can comprise a slit 33. The slit 33 can be generally V-shaped or U-shaped. The slit 33 facilitates a wider opening to accommodate the hand during donning of the glove 10.

The proximal edge of the cuff 28 (i.e., the portion that defines the opening 30 and the slit 33) can be reinforced and finished with edging 34. The edging 34 can reduce the likelihood of fraying material in the glove 10. In some configurations, the edging 34 wraps over the edge of the top panel 12 and the bottom panel 14. The edging 34 can be stitched to the top panel 12 and the bottom panel 14 such that a single row of stitching secures the edging to the outside and inside of the top and bottom panels 12, 14. The edging can be formed of a vinyl strip. Other suitable materials also can be used.

In the illustrated configuration, the opening 30 can be tightened around the wrist of the wearer using a hook and loop fastener assembly 36. The assembly comprises a strip of loop material 38 and a strip of hook fastener material 40. The hook fastener material 40 can grab onto the loop material 38 in any suitable manner.

With reference to FIG. 1, the hook fastener material 40 can be secured to a wrist closure member 42. In some configurations, the hook fasteners can be integrally formed with the wrist closure member 42 or can define the wrist closure member 42. In the illustrated configuration, the hook fastener material 40 can be secured to a back side of the wrist closure member 42. More particularly, in the illustrated configuration, the hook fastener material 40 is stitched to the back side of the wrist closure member 42. Any other suitable technique for securing the hook fastener material 40 to the wrist closure member 42 can be used.

The wrist closure member 42 can be formed of any suitable material. In the illustrated configuration, the wrist closure member 42 is formed of a medium durometer thermoplastic rubber. Any other suitable material also can be used. In some configurations, the perimeter of the wrist closure member includes a stitch groove 44. In such configurations, a double stitch can be positioned within the stitch groove 44 to securely connect the wrist closure member 42 and the hook fastener material. A first end of the wrist closure member can be stitched into position between the inside surface of the bottom panel 14 and the edging 34. Other configurations are possible but the illustrated configuration advantageously draws the slit 33 closed during fastening.

In the illustrated configuration, the loop material 38 spans the full top panel 12 and wraps rearward toward the bottom panel 14. In the illustrated configuration, the loop material 38 spans more than 50 percent of the distance defined by the opening. In the illustrated configuration, the loop material 38 abuts the edging 34 on two sides. In other words, the end edge of the loop material 38 that is closest to the slit 32 and the side edge of the loop material 38 that is most proximal (i.e., furthest from the fingers 16), abuts or underlies the edging 34. In the illustrated configuration, the loop material 38 does not extend the full distance around the opening 30. Rather, the loop material 38 extends along the entire dorsal side of the glove 10 and wraps around the thumb side of the glove 10. Such a configuration advantageously increases the adjustability of the opening size while not significantly impacting the grip on the palmar side of the glove 10. Moreover, contrary to prior constructions in which the hook member was mounted to the body of the glove 10, the illustrated construction secures the loop material 38 to the glove body. The loop material 38 is more flexible than the hook fastener material 40 and, because of the length of the strip of the loop material 38 used in the illustrated configuration, using such a length of hook fastener material 40 would stiffen the opening and decrease comfort. Moreover, because of the increased contact surface area that can result from the lengthened loop material 38, the hook fastener material 40, which is more rigid than the softer loop material 38, is better suited for securing to the wrist closure member 42. It has been found that securing the loop material 38 to the wrist closure member 42 results in the loop material 38 tending to separate from the wrist closure member 42 over time because of the forces encountered during decoupling of the hook fastener material 40 from the loop material 38.

In some configurations, the wrist closure member 42 has a length of 80 mm. In some configurations, the width of the cuff of the glove is 120 mm. In some configurations, the length of the strip of loop material 38 is more than 120 mm. In some configurations, the length of the wrist closure member 42 is ⅔ of the length of the strip of the loop material 38.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A glove comprising a top panel and a bottom panel, the top panel and the bottom panel each comprising a proximal end, the proximal end of the top panel and the proximal end of the bottom panel defining an opening, the opening defining a circumscribing length, the opening also being defined by edges extending in a direction longitudinally away from the proximal end along at least a portion of a side portion of the glove, the side portion comprising a transition between the top panel and the bottom panel, a strip of loop material extending along at least a portion of both the proximal end of the top panel and the proximal end of the bottom panel and having a length of more than 50 percent of the length of the opening while not extending the full length of the opening.

2. The glove of claim 1 further comprising a wrist closure member that is secured to the bottom panel, the wrist closure member having a length of less than ⅔ of the length of the strip of loop material and the wrist closure member comprising a hook fastener material.

3. The glove of claim 2, wherein the hook fastener material is secured to a back side of the wrist closure member.

4. The glove of claim 2, wherein the wrist closure member is at least partially formed of a medium durometer thermoplastic rubber.

5. The glove of claim 1, wherein the side portion corresponds to a little finger of a hand that will be received within the glove.

6. The glove of claim 5, wherein the opening is at least partially circumscribed by edging.

7. The glove of claim 6, wherein the wrist closure member has an end portion that is secured between the edging and the bottom panel.

8. The glove of claim 6, wherein the wrist closure member has an end portion that is secured between an inside of the bottom panel and the edging.

9. The glove of claim 1, wherein the strip of loop material spans a full width of the top panel and wraps rearward to the bottom panel.

10. A glove comprising a top panel and a bottom panel, the top panel having a proximal end, the proximal end defining at least a portion of a cuff of the glove, the proximal end having a length, a strip of loop material secured to a portion of the top panel and to a portion of the bottom panel, the strip of loop material extending along the top panel and having a length longer than the length of the proximal end of the top panel but shorter than a full cuff length defined by the proximal end of the top panel and a proximal end of the bottom panel.

11. The glove of claim 10 further comprising a wrist closure member that is secured to the bottom panel, the wrist closure member having a length of less than ⅔ of the length of the strip of loop material and the wrist closure member comprising a hook fastener material.

12. The glove of claim 11, wherein the hook fastener material is secured to a back side of the wrist closure member.

13. The glove of claim 11, wherein the wrist closure member is at least partially formed of a medium durometer thermoplastic rubber.

14. The glove of claim 11, wherein the opening extends along at least a portion of a side portion of the glove, the side portion also comprising a transition between the top panel and the bottom panel.

15. The glove of claim 14, wherein the side portion corresponds to a little finger of a hand that will be received within the glove.

16. The glove of claim 15, wherein the opening is at least partially circumscribed by edging.

17. The glove of claim 16, wherein the wrist closure member has an end portion that is secured between the edging and the bottom panel.

18. The glove of claim 16, wherein the wrist closure member has an end portion that is secured between an inside of the bottom panel and the edging.

19. The glove of claim 10, wherein the strip of loop material spans a full width of the top panel and wraps rearward to the bottom panel.

20. The glove of claim 10 further comprising an enlarged protective element positioned on the top panel, the protective element being enveloped within an overlay material and being divided into a first portion and a second portion spaced by a stitched region.

* * * * *